US005108313A

United States Patent [19]

Adams

[11] Patent Number: 5,108,313

[45] Date of Patent: Apr. 28, 1992

[54] MODULAR CONNECTOR

[75] Inventor: John E. Adams, Mechanicsburg, Pa.

[73] Assignee: E. I. du Pont de Nemours and Company, Wilmington, Del.

[21] Appl. No.: 417,349

[22] Filed: Oct. 5, 1989

[51] Int. Cl.[5] ..... H01R 9/03

[52] U.S. Cl. ..... 439/610; 439/701

[58] Field of Search ..... 439/610, 701, 725, 906

[56] References Cited

U.S. PATENT DOCUMENTS

| | | | |
|---|---|---|---|
| 3,447,036 | 5/1969 | Dore et al. | 439/701 |
| 3,977,755 | 8/1976 | Edel et al. | 439/610 |
| 4,272,148 | 6/1981 | Knack, Jr. | 439/906 |
| 4,457,576 | 7/1984 | Cosmos et al. | 439/610 |
| 4,749,369 | 6/1988 | Wang | 439/725 |
| 4,824,383 | 4/1989 | Lemke | 439/108 |
| 4,838,808 | 6/1989 | Fujiura | 439/610 |

FOREIGN PATENT DOCUMENTS

| | | | |
|---|---|---|---|
| 2618952 | 2/1989 | France | 439/701 |

*Primary Examiner*—Larry I. Schwartz
*Assistant Examiner*—Hien D. Vu

[57] ABSTRACT

A shielded connector for electrical circuits comprising terminals, such as pins or receptacles, cable comprising wires and a conductive braid surrounding the wires, stackable non-conductive casings which encase the terminal/wire connection, a conductive housing which surrounds and shields the stacked casings and the entire length of the terminals, and an aperture for the cable in the conductive housing, said aperture including a rib for retaining the braid in a substantially fixed position and for providing a continuous electrical ground between the braid and the conductive housing.

8 Claims, 5 Drawing Sheets

MODULAR CONNECTOR

FIELD OF THE INVENTION

The present invention relates to connectors and, more particularly, to shielded connectors.

BACKGROUND OF THE INVENTION

One of the driving forces in connectors today is towards greater pin density. A simple solution to this demand is to merely increase the number of pins within a given connector. However, since the wires to all of the pins in the connector are usually bundled into a single insulated cable and the pins are permanently attached within the connector, this presents significant repair problems. When a single pin or wire fails, the entire connector assembly must be replaced. Various configurations have been suggested to address this need, such as those in U.S. Pat. No. 4,718,867 to Seidel et al. and U.S. Pat. No. 4,550,960 to Asick et al. However, these connectors are complex to manufacture and assemble, and the pins within each connector are not equally spaced. Thus, optimum pin density is not achieved.

Additionally, as the electrical performance of the cable increases, it becomes more difficult to prevent electrical interference from surrounding cables and devices, and more important to properly ground the cable. Various configurations have been disclosed to ground the cable. U.S. Pat. No. 3,141,924 covers the cable termination with a crimped sleeve which has a grounding tab. U.S. Pat. No. 4,416,501 places a metallic U-shaped insulation-piercing grounding element on the cable termination. And U.S. Pat. No. 4,641,906 surrounds the cable termination in a grounding metallic case. Each of these grounding configurations requires a separate additional part to be manufactured and added in the assembly of the connector. There is still a need for connectors capable of high pin density, economic manufacture and assembly, which are easy to repair, and readily grounded and adequately protected to prevent causing and being affected by outside electrical interference.

SUMMARY OF THE INVENTION

The invention is directed to a shielded connector for electrical circuits comprising:

- electrically conductive terminals connectable to at least one electrically conductive cable comprising electrical conductors;
- at least two non-conductive casings containing said electrically conductive terminals, the casings being stackable such that the distance from the center-line of one terminal to the center-line of an adjacent terminal in the same casing is substantially the same as the distance from the center-line of a terminal in one casing to the center-line of an adjacent terminal in another casing;
- an electrically conductive housing surrounding and shielding said stacked non-conductive casings and said electrically conductive terminals;
- a braid surrounding the electrically conductive cable; and
- an aperture for the electrically conductive cable in the electrically conductive housing, said aperture including a rib for retaining the braid in a substantially fixed position and for providing a continuous electrical ground between the braid and the electrically conductive housing.

BRIEF DESCRIPTION OF THE DRAWINGS

FIG. 6 shows an exploded perspective view of a male connector having three casings and a 6×6 pin array.

DETAILED DESCRIPTION

The present invention relates to a shielded connector for electrical circuits comprising at least two nonconductive casing (preferably made of plastic) containing electrically conductive terminals, said terminals being connectable to electrically conductive cable, and an electrically conductive housing (preferably made of metal or metallized plastic) that shields the nonconducting casings and terminals. The terminals may be male (e.g., pins), female (e.g., receptacles), or hermaphroditic.

Figure 4:
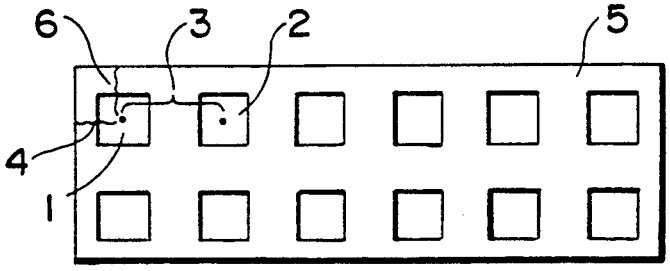
FIG. 4 shows an end view of a casing for a 2×6 terminal array.

The nonconductive casings are designed such that they can be stacked end-to-end or side-to-side, the distance from the center-line of one terminal to the center-line of an adjacent terminal in the same casing being substantially the same as the distance from the center-line of a terminal in one casing to the center-line of an adjacent terminal in another casing. An example of such a casing is illustrated in FIG. 4. The distance 3 from the center-line of terminal 1 to the center-line of terminal 2 is twice the distance 4 from the center-line of terminal 1 to the edge of casing 5. Likewise, distance 6 from the center-line of terminal 1 to the edge of casing 5 is one-half distance 3.

A large, consistent terminal array may be formed by stacking the appropriate number of casings in the desired configuration. When a terminal fails, only the individual casing that contains the failed terminal needs to be replaced rather than the entire connector. Also, terminal arrays of varying sizes can be formed using a plurality of basic, standard sized casings rather than producing a casing for every different terminal array size and arrangement. For example, a pin array having six rows of pins with thirteen pins in each row (a 6×13 pin array) may be formed by stacking three 2×13 pin casings side-by-side, a 4×13 pin array may be formed by stacking two 2×13 pin casings side-by-side, and a 2×26 pin array may be formed by stacking two 2×13 pin casings end-to-end.

The possible size of the terminal array is limited only by the ability of the conductive housing to maintain the electrical integrity of the connection. That is, the housing must prevent the connection from emitting interfering electrical energy beyond acceptable limits and protect the connection from interference by ambient electrical energy. To do this, the nonconductive casings and the terminals therein are placed in the conductive housing which surrounds the casings and the entire length of the terminals. The housing usually consists of only two elements (not including fastening means, such as screw, for holding the two elements together). Each element is capable of mating with the other element to form the conductive housing. The conductive housing on each connector, in turn, is capable of mating with a corresponding shielded terminal array. For example, the conductive housing surrounding an array of pins may be wider at the end where the pins are exposed in order to telescope onto the end of a conductive housing surrounding a complementary array of receptacles.

To assure that mating connectors are engaged only in the proper electrical alignment, the conductive housing may be polarized. That is, the conductive housing may be designed such that it mates with housing surrounding a complementary terminal array only in the proper electrical alignment of the terminals. This design can be a simple tab on the outside wall of the telescoped housing and a tab on the inside wall of the telescoping housing. When the housings are properly aligned, the tabs do not interfere with the mating of the housing and the connection is made. But, when the housings are improperly aligned, the tabs interfere with each other, the housings cannot mate and the connection cannot be made. These polarized housings assure that the electrical signal consistently goes to its proper destination by permitting only the same, proper connection each time. Such proper and consistently reproducible electrical connections are highly desirable in the electronics industry.

In addition to the foregoing features of the conductive housing, it also has at least one aperture for cable. To carry the electrical signal to the terminals in the connection, the terminals are connected electrically to conductors (e.g., wires, usually copper). These conductors are bundled into cables. The present invention permits the conductors to be bundled in a variety of ways. For example, all the wires connected to terminals in a single conductive housing can be bundled into a single cable. Or, the wires connected to the terminals in a single non-conductive casing may be bundled into a cable. Any number of cables may be used. The main considerations for determining the optimum number of cables are space and repairability. As the number of cables increase, it becomes more economical to repair the cables because fewer conductors will need to be replaced when a single conductor in the bundle fails. However, space for these cables is usually restricted by need for space for other components and the size of the housing.

To protect the length of conductor outside of the housing, a conductive braid surrounds each bundle of conductors. This braid protects the conductors from electrical interference and provides a means for grounding the conductors for safety. The braid, in turn, is covered with insulation. In order for the conductors to be effectively grounded, the braid is electrically connected to the conductive housing. The present invention provides a conductive rib in the surface of the housing aperture. This rib pinch fits the braid termination in the aperture. The pinching contact electrically connects the braid and the housing to form a continuous Gaussian surface. The rib comprises a raised surface opening defined by the aperture. The pinch fit also helps secure the cable in the housing. However, when the cable is subject to stress (axial) forces, the pinch fit of the braid termination may not provide adequate strain relief. A ferrule comprising a sleeve and flange may be used to provide additional strain relief. The ferrule may be plastic or metallic and is positioned over the end of the conductors such that the sleeve lies between the conductors and the braid and is pinched by the braid rib of the housing. When axial forces are exerted on the cable, the pinch fit of the rib will not only provide strain relief, it will interfere with the flange of the ferrule to prevent the cable from being pulled away from the connector.

Figure 1:
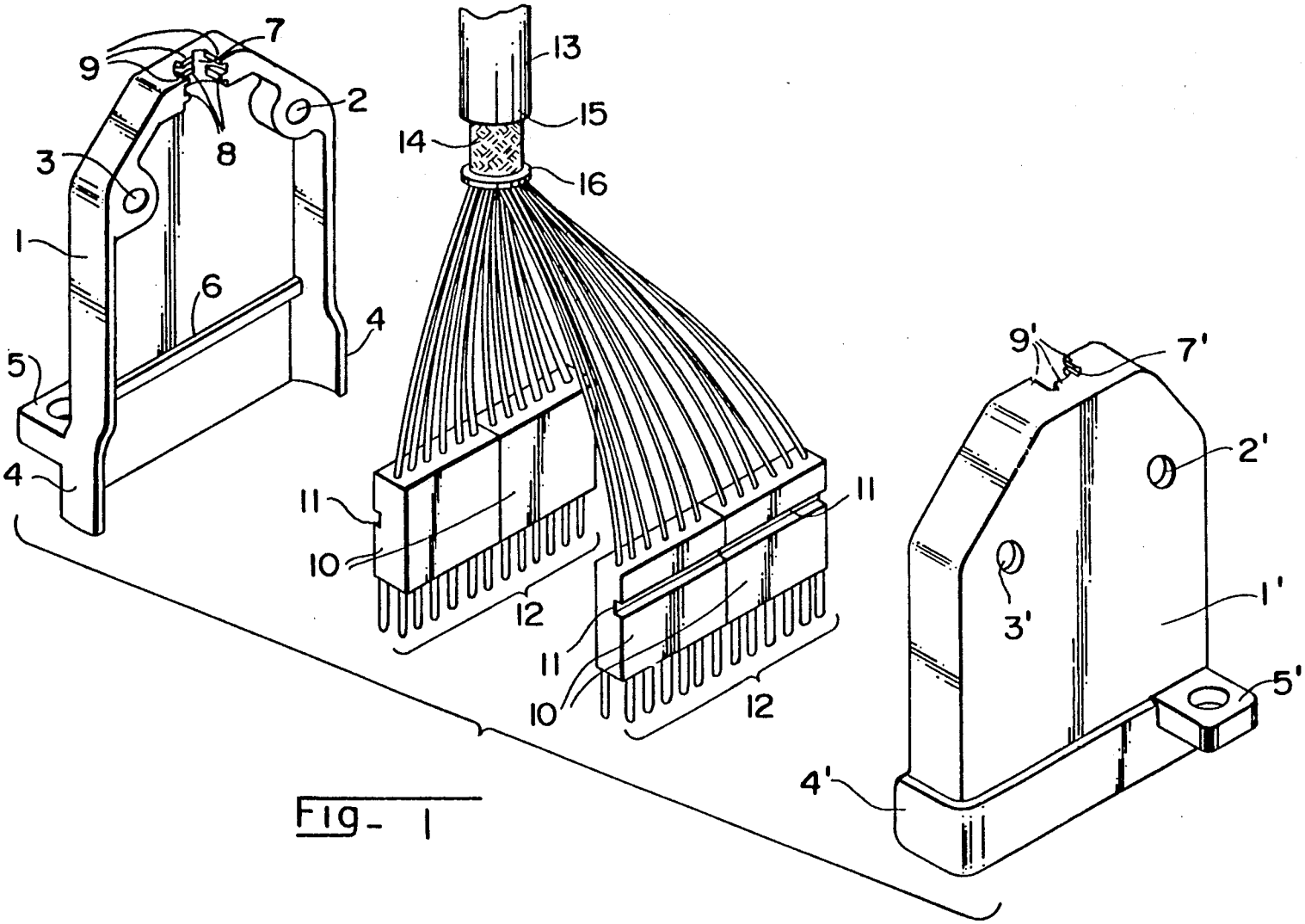
FIG. 1 shows an exploded perspective view of a male connector having four casings and a 4×12 pin array, all of the electrical conductors being bundled into a single cable insulated by a braid and expandable cover.

FIG. 1 illustrates one embodiment of the invention. The conductive housing comprises elements 1 and 1' which mate and are held together by securing a fastening means, such as a screw, in holes 2 and 2' which are aligned to form a continuous opening for the screw, and likewise, a second screw in holes 3 and 3'. Ends 4 and 4' of the housing elements are flared so as to telescope over a corresponding receptacle array and housing, if provided, in order to shield the actual interconnection of pin and receptacle. Tabs 5 and 5' have holes through which a fastening means, such as a screw, may be inserted to fix the position of the connector either before or after it is mated with a complementary connector.

A ledge 6 is provided on the inner surface of each housing element. If the housing is die cast, the ledge may be formed as part of the inner surface of the element in the die casting process. This ledge mates with groove 11 of casings 10 to fix the position of the casings and pins 12 within the assembled connector. Ledge 6 and groove 11 are positioned on the inner surface of the housing and the face of the casing, respectively, such that the entire length of the pins 12 is shielded by the housing.

Figure 2:
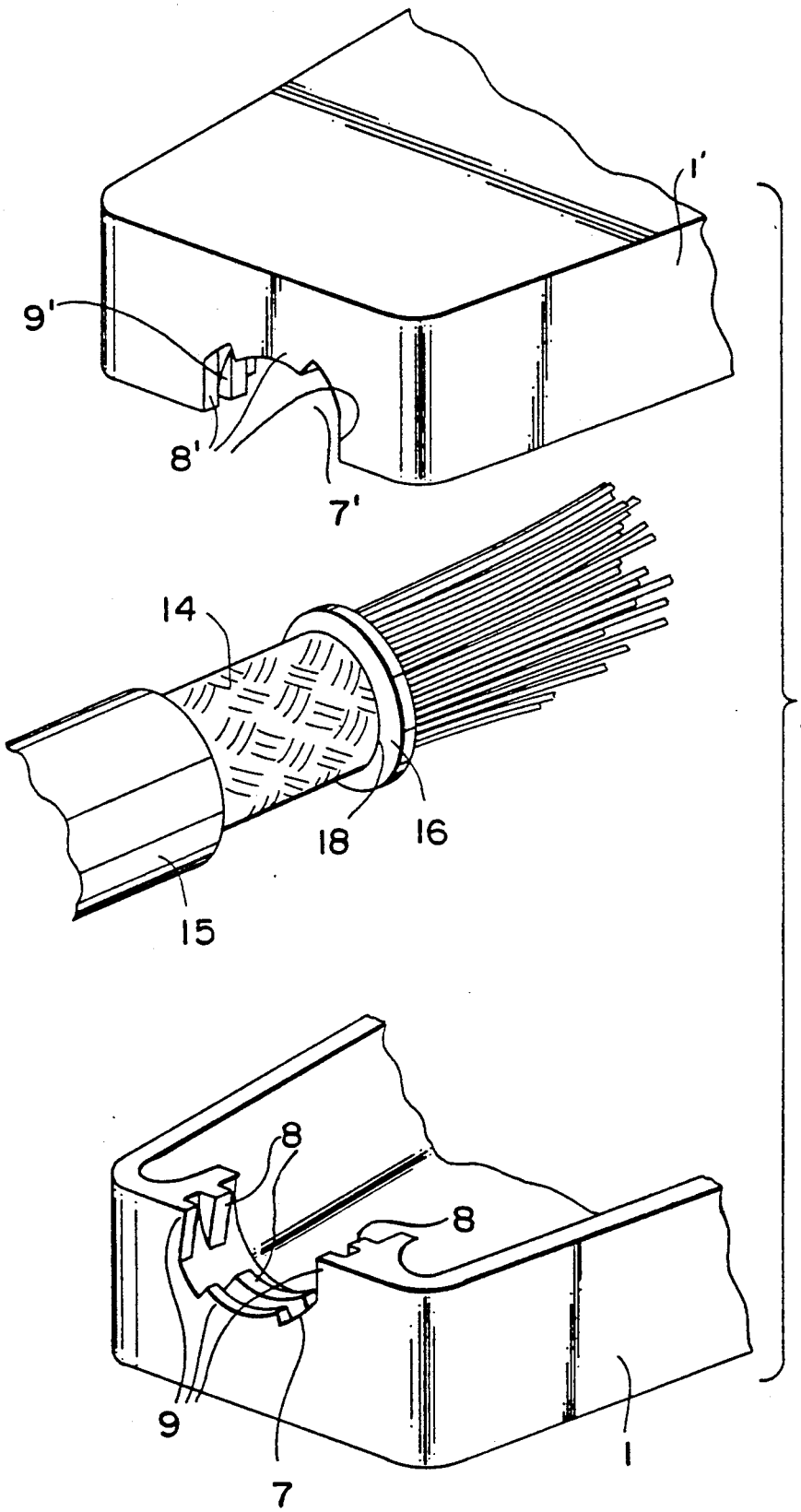
FIG. 2 shows an exploded view of the cable, conductive housing aperture for the cable and ribs of FIG. 1.

Aperture 7 for cable 13 contains two sets of ribs. Ribs 8 pinch fit and electrically connect with conductive braid 14. Ribs 9 pinch fit the insulation 15 which covers braid 14. If the housing is die cast, these ribs may be formed as part of the surface of the aperture in the die casting process., FIG. 2 shows aperture 7 and cable 13 in greater detail. Ribs 8 and 9 are raised surfaces of tabs which extend form the circumference of the aperture towards the center of the aperture. The surface of ribs 8 that face the center of the aperture is curved for maximum contact with the curved surface of braid 14. Insulation 15 is terminated short of the braid termination 18 so that the braid may be in direct contact with ribs 8. Insulation 15 is pinch fit by ribs 9 to maintain the insulation in a relatively fixed position and relived stress exerted on the cable. The surface of each rib 9 that faces the center of the aperture is curved for maximum contact with the curved surface of the insulation.

Figure 3:
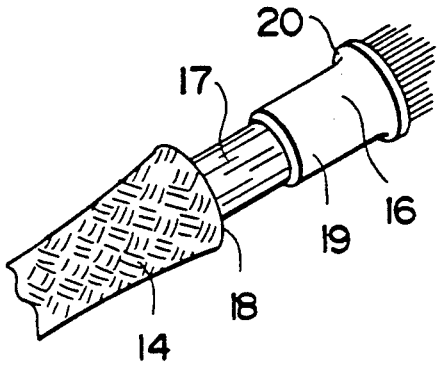
FIG. 3 shows an exploded view of a cable, braid and ferrule.

To provide additional strain relief, ferrule 16 is provided. FIG. 3 shows the position of the ferrule relative to braid 14 in greater detail. The ferrule comprises sleeve 19 and flange 20. The sleeve contains wires 17 which are electrically connected to encased terminals in the conductive housing. The ferrule is placed over the wires as shown and pushed towards the braid until the braid termination 18 contacts or nearly contacts flange 20. The sleeve will the be positioned between the wires and the braid. The outer diameter of the flange should be greater than the outer diameter of the braid. In this way, if stress is exerted on the cable, the flange will butt against ribs 8 thereby relieving the cable of the stress.

Figure 5:
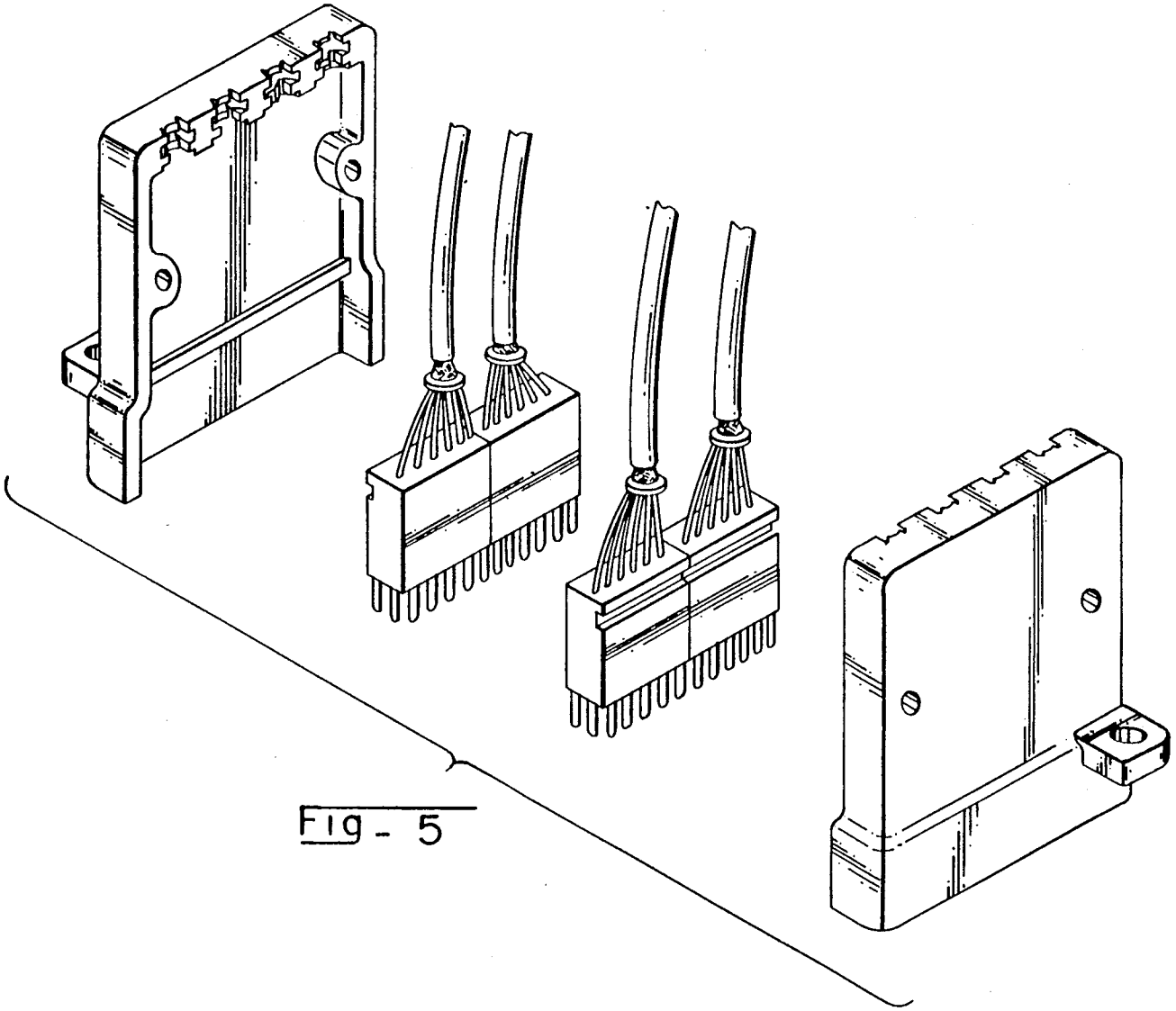

FIG. 5 shows a connector like that of FIG. 1 wherein the wires to each casing are bundled into an individual casing. Four apertures having ribs are provided in the conductive housing to accommodate each of the cables.

Figure 6:
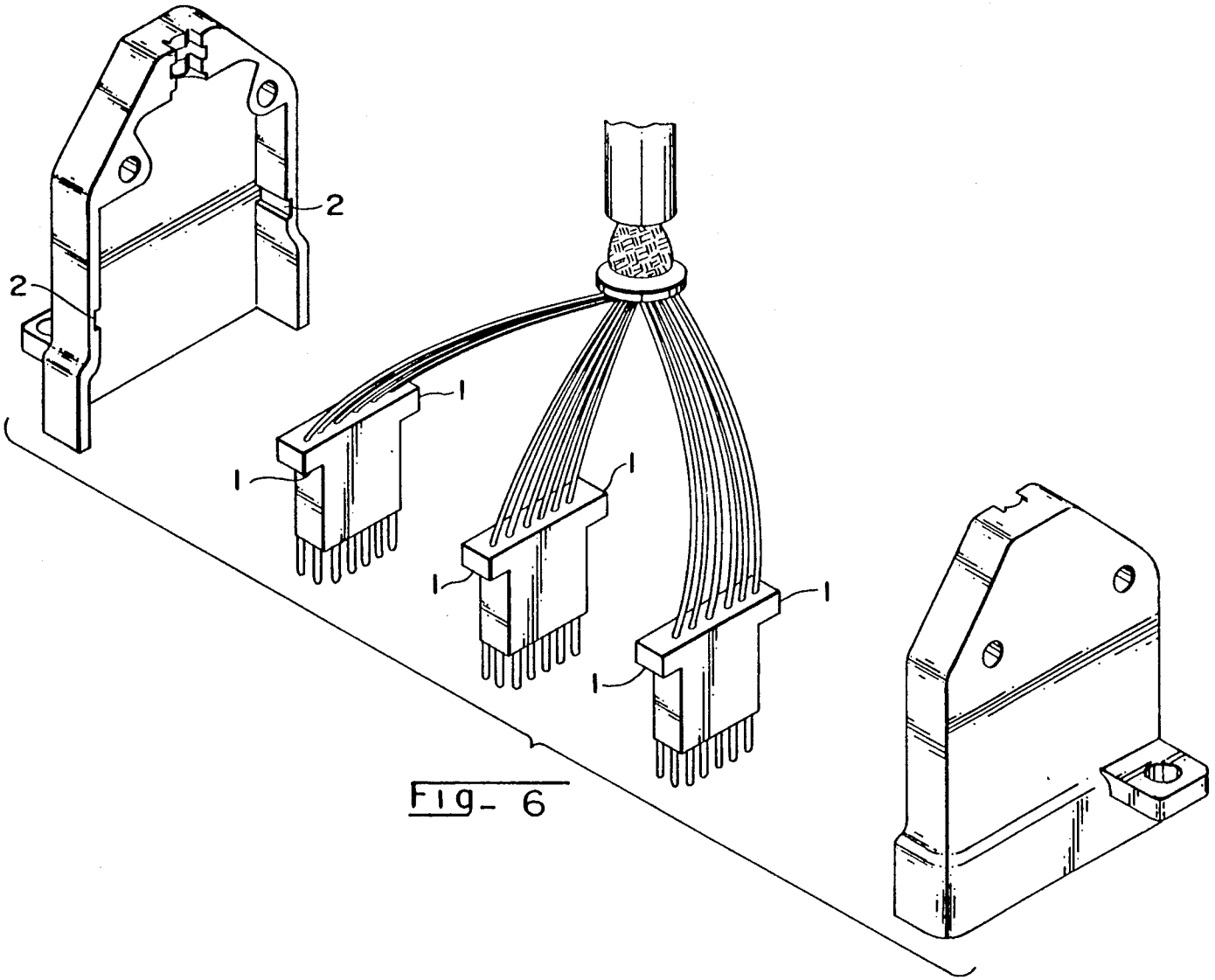
FIG. 6 shows an exploded perspective view of a male connector having four casings and a 4×12 pin array, the electrical conductors from each casing being bundled into a separate cable insulated by a braid and expandable cover.

FIG. 6 shows an alternate means for fixing the position of the casings and terminals in the conductive housing. Instead of the inner surface of the housing having a ledge and a surface of the casings having a groove as shown in FIG. 1, here the casings have a ledge 1 and the inner surface of the housing has a mated groove 2. The aggregate pin array formed is 6×6. Clearly, different size casings accommodating different numbers of pins may be used. For example, three casings each having a 2×13 pin array can be stacked as shown in FIG. 6 to form a 6×13 array.

It is to be understood that the forms of the invention shown and described herein are but preferred embodiments and various changes may be made without departing from the spirit and scope of the invention.

I claim:

1. A shielded connector for electrical circuits comprising:

electrically conductive terminals connectable to at least one electrically conductive cable comprising electrical conductors;

at least two non-conductive casings containing said electrically conductive terminals, the casings being stacked end-to-end or side-to-side in an abutting relationship such that the distance from the center-line of one terminal to the center-line of an adjacent terminal in the same casing is substantially the same as the distance from the center-line of a terminal in casing to the center-line of an adjacent terminal in another casing;

an electrically conductive housing surrounding and shielding said stacked non-conductive casings and said electrically conductive terminals;

a braid surrounding the electrically conductive cable; and an opening for the electrically conductive cable in the electrically conductive housing, said opening including a rib for retaining a braid in a substantially fixed position and for providing a continuous electrical ground between the braid and the electrically conductive housing.

2. A shielded connector according to claim 1 further comprising a ferrule comprising a sleeve and a flange mounted on the cable such that the sleeve lies between the electrical conductors and the braid.

3. A shielded connected according to claim 1 wherein the electrically conductive terminals are pins and the electrically conductive housing surrounding the pins telescopes onto the end of a mated connector.

4. A shielded connector according to claim 1 wherein the electrically conductive terminals are receptacles.

5. A shielded connector according to claim 1 wherein the electrical conductors are bundled into a single cable.

6. A shielded connector according to claim 1 wherein the braid is surrounded by an expandable insulative cover.

7. A shielded connector according to claim 1 wherein the electrically conductive housing is polarized.

8. A shielded connector according to claim 1 wherein the electrically conductive housing comprises at least two elements, each of said elements being capable of mating with the other of said elements to form said electrically conductive housing and surround said non-conductive casings and electrically conductive terminals.

* * * * *